United States Patent [19]

Kasahara et al.

[11] 4,220,103

[45] Sep. 2, 1980

[54] AUXILIARY TABLE FOR SEWING MACHINES OF A FREE ARM TYPE

[75] Inventors: Takahiko Kasahara; Shigeharu Shichi, both of Anjo; Senji Suito, Kariya, all of Japan

[73] Assignee: Aisin Seiki Kabushiki Kaisha, Aichi, Japan

[21] Appl. No.: 59,033

[22] Filed: Jul. 19, 1979

[30] Foreign Application Priority Data

Aug. 10, 1978 [JP] Japan ..... 53-110403[U]

[51] Int. Cl.[2] ..... D05B 73/00

[52] U.S. Cl. ..... 112/260

[58] Field of Search ..... 112/258, 260, 217.1, 112/13, 63; 108/145

[56] References Cited

U.S. PATENT DOCUMENTS 3,013,514 12/1961 Stanton ..... 112/260

3,863,582 2/1975 Patricia et al. ..... 112/258

FOREIGN PATENT DOCUMENTS 572238 9/1945 United Kingdom ..... 112/260

*Primary Examiner*—Werner H. Schroeder

*Assistant Examiner*—Andrew M. Falik

*Attorney, Agent, or Firm*—Oblon, Fisher, Spivak, McClelland & Maier

[57] ABSTRACT

An auxiliary table for sewing machines of free arm type which includes a main body, a cylindrical bed integrated with the main body, a base member fixed to the main body, a hinge plate rotatably mounted on the base member at one end thereof, and an auxiliary table engaged with the other end of the hinge plate and slidable therewith toward and away from the cylindrical bed. A plate spring is connected to the base member for downwardly biasing the hinge plate, thereby preventing the hinge plate from swinging movement and the auxiliary table from vibrating for flat work sewing. The hinge plate provides for the auxiliary table to be moved in a first position in contact with the free arm while for tubular work sewing the table can be swung in a second position separately from the arm.

5 Claims, 5 Drawing Figures

AUXILIARY TABLE FOR SEWING MACHINES OF A FREE ARM TYPE

BACKGROUND OF THE INVENTION

1. Field of the Invention

The present invention relates generally to an auxiliary table for sewing machines and more particularly to an auxiliary table for sewing machines having a cylindrical bed.

2. Background of the Invention

Generally, sewing machines having a cylindrical bed are called sewing machines of a free arm type and are supplied with an auxiliary table which is separated from a main body of sewing machines. The auxiliary table is detached or attached from or to the main body of sewing machines according to the type of cylindrical bed which is used. This means that the auxiliary bed should be detached from the main body upon sewing cylindrical shaped objects and should be attached to the main body upon sewing flat shaped objects. As a result, preparation for detaching or attaching the auxiliary table becomes troublesome and complicated. Therefore efficient utilization of an auxiliary table in combination with a cylindrical bed is not achieved.

SUMMARY OF THE INVENTION

An important object of the present invention is to provide an auxiliary table for sewing machines having a cylindrical bed which can obviate the drawbacks according to the above-mentioned conventional sewing machines.

Another object of the present invention is to provide a sewing machine having a work support surface which can be easily converted into a cylindrical bed for sewing tubular objects.

A further object of the present invention to is to provide an auxiliary table for sewing machines having a cylindrical bed which is simplified and compact in construction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Reference will now be made in detail to the present preferred embodiment of the invention, an example of which, as indicated hereinabove, is illustrated in the accompanying drawings.

Figure 1:
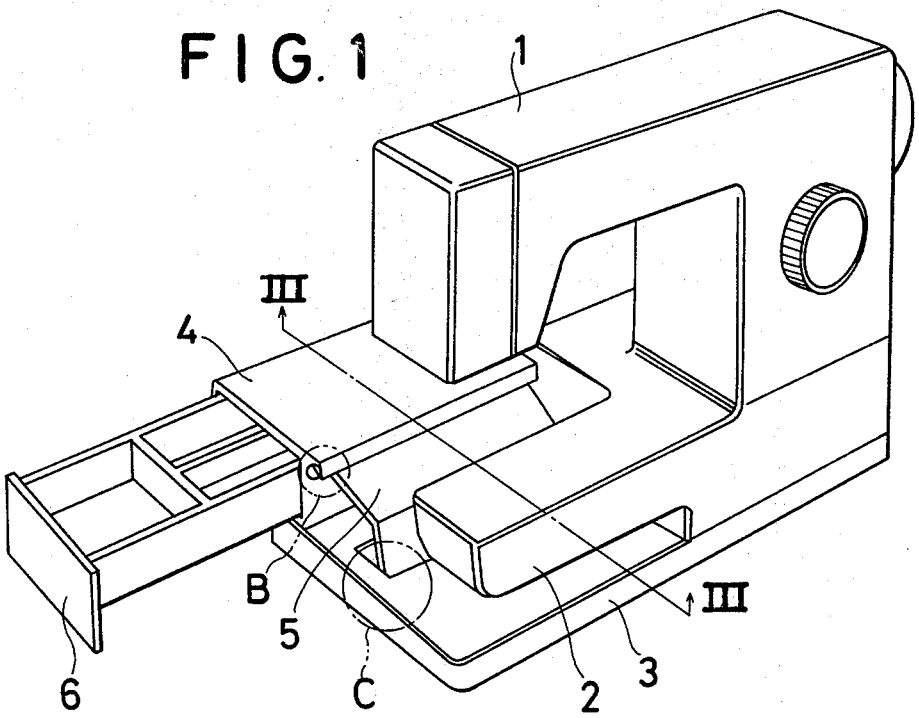
FIG. 1 shows an auxiliary table for sewing machines having a cylindrical bed in accordance with the present invention.
Figure 2:
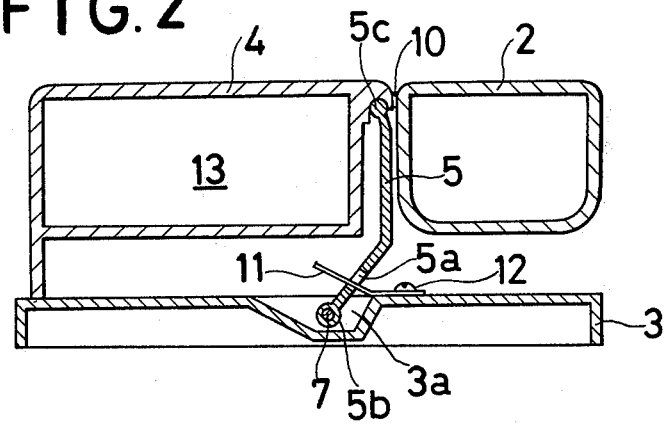
FIG. 2 is a side-sectional view showing a flat sewing state of the present invention.

With particular reference to FIG. 1, reference numeral 1 denotes the main body of a sewing machine. A cylindrical bed 2 is integrated with the main body 1, and a base 3 is fixed to the main body 1 at the bottom portion thereof. Reference numeral 4 shows a rectangular auxiliary table which is integrally extruded and molded of aluminum, etc. The auxiliary table 4 is provided with a space 13 for housing, for example, a drawer 6 for accomodating sewing tools therein as shown in FIG. 2. A hinge plate 5 of molded aluminum, for example, is of a plate shaped configuration which functions as a linkage member. Both ends of the hinge plate 5 are spherical and elongated and two holes **5*a* are provided on the hinge plate 5**.

Figure 4:
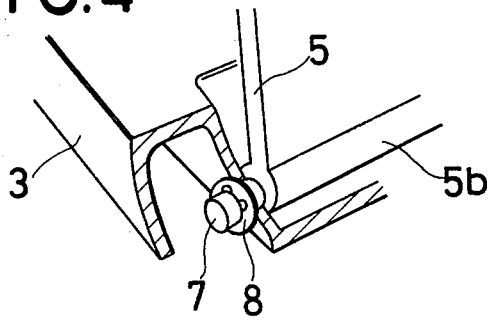
FIG. 4 is a partially enlarged view of the C portion of FIG. 1, however, showing the engaging state of the base and the hinge plate.
Figure 5:
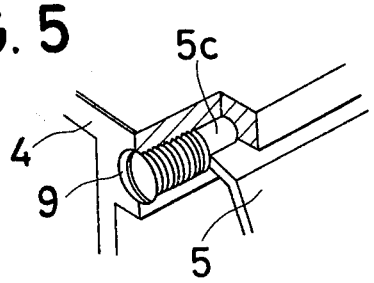
FIG. 5 is a similar view to FIG. 4, showing, however, the B portion of FIG. 1.

One end of the hinge plate 5 is located in a cavity **3*a* of the base 3. A lower end portion 5*b* of the hinge plate 5 is rotatably supported by an axle 7 mounted on the base 3, and is prevented from axially slipping off from the axle 7 by a stopper ring 8 as shown in FIG. 4. An upper end portion 5*c* of the hinge plate 5 is pivotably mounted to the auxiliary table 4. The longitudinal movement of the upper end portion 5*c* is limited by a stopper screw 9 as shown in FIG. 5**.

Reference numeral 10 shows a cushion member which is elastic and made of rubber and felt, etc. The cushion member 10 is fixedly attached to a front end portion of the auxiliary table 4 for thereby filling any gaps between the table and bed when both members are positioned adjacent one another. One end of the hinge plate 5 is always downwardly urged by a plate spring 11 of which one end is fixed to the base 3 by a screw 12 and the other end is inserted into a hole **5*a* of the hinge plate 5, thereby preventing the hinge plate 5 from swinging movement and also the auxiliary table 4** from vibrating.

Operation of the embodiment will now be described. In that flat state where the auxiliary table 4 is contacted with the cylindrical bed 2 as shown in FIG. 2, the auxiliary table 4 is leftwardly slidable on the base 3 as a fulcrum of the axle 7 through the hinge plate 5 which rises vertically. However, in this state the auxiliary table 4 is downwardly urged by the plate spring 11, thereby maintaining an identical plane for the flat sewing by the auxiliary table 4 and the cylindrical bed 2.

Figure 3:
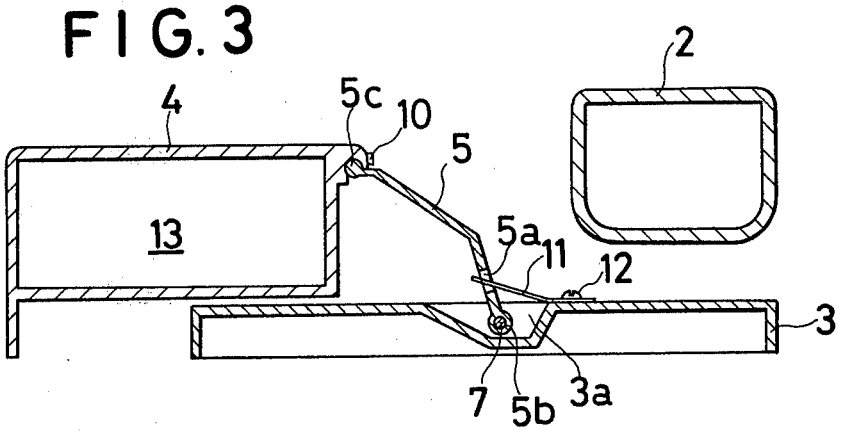
FIG. 3 is a similar view to FIG. 2, however taken along III—III in FIG. 1.

In the abovementioned state where the identical plane for the flat sewing is maintained by the auxiliary table 4 and the cylindrical bed 2, the auxiliary table 4 is leftwardly pushed as a fulcrum of the axle 7 shown in FIG. 3. By this leftward movement of the auxiliary table 4, the auxiliary table 4 is separately located from the cylindrical bed 2 thereby preparing the cylindrical bed 2 for cylindrical shaped objects.

Briefly, the auxiliary table 4 can be displaced from the identical plane with the cylindrical bed 2 for the sewing state of flat shaped objects to the separate location from the cylindrical bed 2 for the sewing state of cylindrically shaped objects if necessary, and vice versa.

Obviously, numerous modifications and variations of the present invention are possible in light of the above teachings. It is therefore to be understood that within the scope of the appended claims, the invention may be practiced other than as specifically described herein.

What is claimed as new and desired to be secured by letters patent of the United States is:

1. A sewing machine having a main body, a cylindrical bed integrated with said main body and a base member fixed to said main body, comprising:

a hinge plate rotatably mounted on said base member at one end thereof;

an auxiliary table engaged with the other end of said hinge plate and slidable therewith relative to said cylindrical bed whereby said table can be brought into a position either continguous to the cylindrical bed or spaced therefrom; and means for biasing said hinge plate, wherein swinging movement of said hinge plate and vibration of said auxiliary table is prevented.

2. A sewing machine as set forth in claim 1, said hinge plate including a hole formed therein and said means for biasing said hinge plate comprising a plate spring of which one end is fixed to said base member and the other is inserted into said hole formed by said hinge plate.

3. A sewing machine as set forth in claim 2, said base member comprising means for rotatably supporting one end portion of said hinge plate about an axis of rotation and the other end thereof is pivotably mounted to the auxiliary table.

4. A sewing machine as set forth in claim 3, said hinge plate comprising spherical portions formed at both ends thereof for cooperation with said auxiliary table and said base plate, respectively.

5. A sewing machine as set forth in claim 4, further comprising an elastic cushion member fixedly attached adjacent one end portion of said auxiliary table.

* * * * *